US005079859A

United States Patent [19]

De Bortoli et al.

[11] Patent Number: 5,079,859

[45] Date of Patent: Jan. 14, 1992

[54] REAR-ENTRY SKI BOOT

[75] Inventors: Giuseppe De Bortoli, Montebelluna; Claudio Zorzi, Silea, both of

[73] Assignee: Nordica S.p.A., Montebelluna, Italy

[21] Appl. No.: 523,683

[22] Filed: May 15, 1990

[30] Foreign Application Priority Data

May 30, 1989 [IT] Italy ..... 82550 A/89

[51] Int. Cl.[5] ..... A43B 5/04

[52] U.S. Cl. ..... 36/117; 36/120

[58] Field of Search ..... 36/117-121

[56] References Cited

U.S. PATENT DOCUMENTS

| | | | |
|---|---|---|---|
| 3,396,479 | 8/1968 | Primak | 36/117 X |
| 4,083,129 | 4/1978 | Collombin et al. | 36/117 |
| 4,190,970 | 3/1980 | Annovi | 36/117 X |
| 4,619,057 | 10/1986 | Sartor et al. | 36/120 X |
| 4,669,201 | 6/1987 | Pozzobon | 36/120 X |
| 4,677,768 | 7/1987 | Benoit et al. | 36/117 |
| 4,760,653 | 8/1988 | Baggio | 36/117 |
| 4,765,069 | 8/1988 | Baggio et al. | 36/117 X |
| 4,769,929 | 9/1988 | Sartor | 36/117 |
| 4,918,842 | 4/1990 | Lederer | 36/102 X |

FOREIGN PATENT DOCUMENTS

| | | | |
|---|---|---|---|
| 3506057 | 2/1986 | Fed. Rep. of Germany | 36/117 |

*Primary Examiner*—Paul T. Sewell
*Assistant Examiner*—Ted Kavanaugh
*Attorney, Agent, or Firm*—Guido Modiano; Albert Josif

[57] ABSTRACT

A rear-entry ski boot includes a quarter closure device constituted by a rear vertical lever which tensions one or more traction elements. Temporary engagement with the one or more traction elements are provided on the body of the vertical lever or on at least one of the quarters, and the temporary engagement allow the partial take-up of the working length of the traction elements when the rear vertical lever is open. A boot is thus provided with which the skier can walk easily.

3 Claims, 2 Drawing Sheets

REAR-ENTRY SKI BOOT

BACKGROUND OF THE INVENTION

The present invention relates to a ski boot.

There are currently two main types of known ski boots: the rear-entry type and the mixed structure type. The rear-entry type comprises a front quarter and a rear quarter, associated with a rigid shell, the rear quarter can be tilted downward to allow the insertion of the foot from the rear. The mixed-structure type comprises a front quarter and a rear quarter associated with a shell having overlapping flaps.

In said known types of boots it is known to use, as a quarter closure element, a vertical lever which is advantageously associated at the back of the rear quarter and tensions one or more traction elements such as cables.

In use, the vertical lever can be firmly placed in two positions: a closed position, in which the cables are tensioned, and an open position, in which the cables are slackened to allow the rotation of the rear quarter and therefore the removal of the foot.

The disadvantage of these known types of ski boots is constituted by the fact that easy walking while wearing the boot is not possible in any of the two positions in which the vertical lever can be arranged.

In the closed position, the leg is in fact forced to remain bent forward, whereas in the open position the rear quarter does not rest on the calf, making the foot slip out.

As a partial solution to these disadvantages, a ski boot has been devised having a vertical lever, associated with a rear quarter, and comprising a device which provides for two different degrees of closure of the rear quarter.

Though this known device provides for the complete closure of the quarters, when the lever is closed, or the partial opening thereof for walking, there are some disadvantages: it is in fact indispensable to open the lever in order to change the tensioning of the cable, since it is necessary to act on an adapted transmission element, and subsequently close said lever; this forces the skier to perform an additional operation.

Furthermore, due to the small size of the cable transmission element, said element is not easy to activate when wearing skiing gloves or with ice on the lever.

The known device is furthermore structurally complicated and, because of said transmission element, does not allow, due to lack of space, to insert a device for adjusting the tension of the cables for quarter closure contained inside the lever arm; said device must necessarily be provided at the quarters.

A rear-entry ski boot is also known which has, at the back of the rear quarter, a vertical lever associated with adapted wings by means of the interposition of a pair of connecting rods.

This solution has the same disadvantages indicated for the preceding known device, except for the fact that this solution allows to insert cable tension adjustment systems inside the lever arm.

In addition, however, this known system has a further disadvantage: it is necessary to provide room, at the shell, for accommodating the lever, which room is equal to the length of said lever, plus twice the axis distance of the connecting rods.

Given a set available space in the rear quarter, since the length of the lever is limited by the fact that interactions with the ski fastening must be avoided, the size of said lever must be decreased and the effort to be applied in order to close the quarters is thus increased.

SUMMARY OF THE INVENTION

The aim of the present invention is to eliminate the disadvantages described above in known types by providing a ski boot which allows to optimally close the quarters and at the same time allows the skier to walk optimally in an erect stance without the foot slipping out.

Within the scope of the above described aim, an important object is to provide a ski boot which has a very small number of components and that can be easily manufactured industrially.

Not least object is to provide a ski boot which associates with the preceding characteristics that of being reliable and safe in use.

The above described aim and objects, as well as others which will become apparent hereinafter, are achieved by a ski boot comprising a front quarter and a rear quarter associated with a shell and a device for closing said quarters, said device comprising a lever which tensions one or more traction elements, characterized in that it comprises at least one means for temporary engagement with said one or more traction elements and for the partial take-up of the working length of said traction elements when said lever is open, said means being provided on the body of said lever or on at least one of said front and rear quarters.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
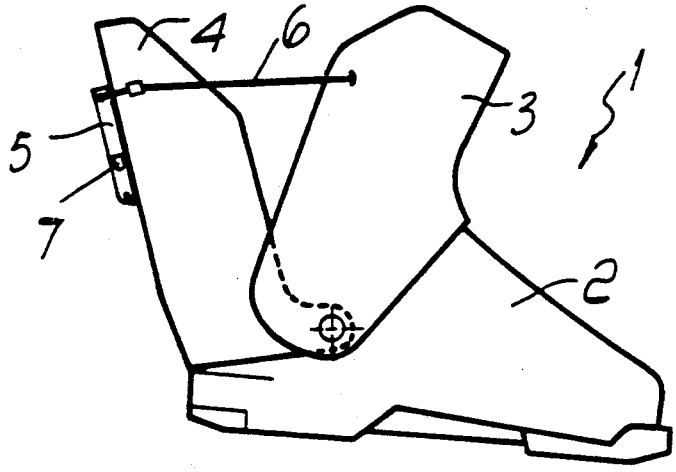
FIG. 1 is a view of a ski boot with the vertical lever in the open position and with the quarters completely open.

With reference to the above figures, the reference numeral 1 indicates a ski boot which comprises a shell 2, either of the type with overlapping flaps or of the rigid monolithic type, with which a front quarter 3 and a rear quarter 4 are associated.

An adapted closure device, such as a vertical lever 5 associated at the back and transversely to the rear quarter, allows the closure of the front quarter 3 and of the rear quarter 4.

One or more traction elements such as cables 6 are associated with said vertical lever.

Means for temporary engagement with said one or more traction elements and for the partial take-up of the working length of said traction elements when the rear vertical lever is open are associated with the vertical lever 5; said means are constituted by a pair of lugs 7 which protrude perpendicularly to the lateral surfaces 8 of the lever 5 proximate to the axis 9 of articulation to the rear quarter 4.

Said lugs 7 advantageously have a semicircular configuration with the base directed toward the axis 9.

Said lugs 7 can naturally be provided integral with the lever 5 or be applied thereto.

Figure 2:
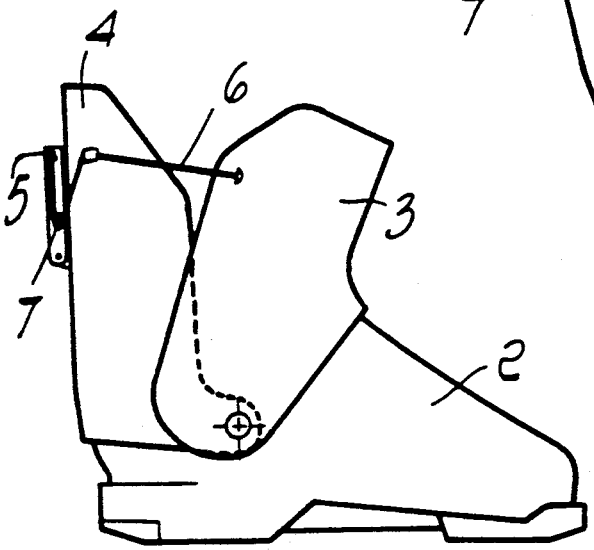
FIG. 2 is a view of the boot of FIG. 1 with the rear lever in the open position and with the rear quarter partially open for walking.
Figure 3:
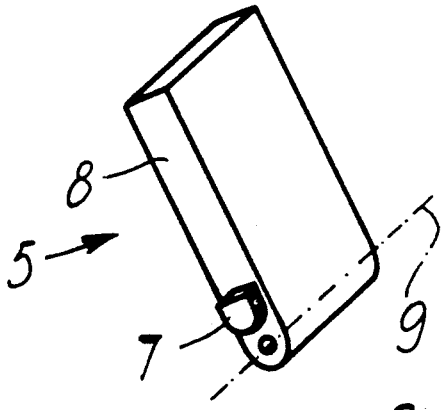
FIG. 3 is an isometric detail view of the vertical lever.

As illustrated in FIGS. 1 and 2, the skier can arrange the lever 5 in the open position, either engaging the cables 6 with the lugs 7 or not engaging said cables with the lugs 7.

Two distinct positions are thus obtained in which, as illustrated in FIG. 1, it is possible to completely open the quarters in order to remove or insert the foot inside the shell 2 or, as illustrated in FIG. 2, to obtain a position in which the quarters are partially open so that the rear quarter 4 is approximately perpendicular to the ground so as to allow the skier to walk optimally.

It has thus been observed that the invention achieves an optimum closure of the quarters and allows the skier to walk optimally with an erect stance without the foot slipping out.

The device according to the invention is furthermore reliable and safe in use and made of a very small number of components which thus allows to optimally contain the manufacturing costs.

Finally, the operations to be performed do not require the opening and subsequent closure of the lever, and the actuation of the device is easy in all conditions; good ergonomics of the device is thus achieved.

The device according to the invention is naturally susceptible to numerous modifications and variations, all of which are within the scope of the same inventive concept.

Figure 4:
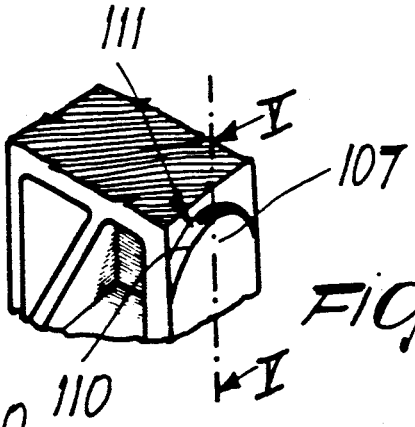
FIG. 4 is a view of a second embodiment of the means for temporary engagement with said one or more traction elements and for the partial take-up of the working length of said traction elements.
Figure 5:
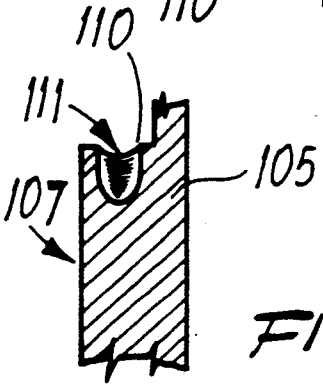
FIG. 5 is a view of the lever of the preceding figure, taken along the sectional plane V—V of FIG. 4.
Figure 6:
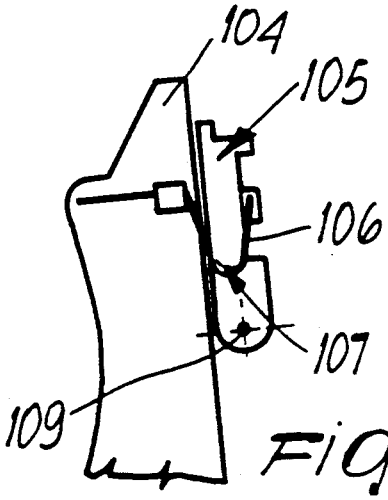
FIG. 6 is a partial side schematic view of the vertical lever applied to the rear quarter, according to the preceding figure.

Thus, for example, FIGS. 4, 5 and 6 illustrate a second embodiment in which a vertical lever 105 is again pivoted at one end to the rear quarter 104 along a transverse axis and has, proximate to the quarter pivoting axis 109, a means for temporary engagement with one or more traction elements, such as cables 106, constituted by a lug 107 which has, at the curved end surface 110 directed toward the axis 109, a groove 111 for the temporary engagement of the cables 106.

Advantageously, said groove 111 has a portion with an involute profile to allow the automatic disengagement of the cable 106 during the closure step before the lever reaches the point of maximum stress.

In this manner the cable is driven out of the groove 111 by virtue of the angular movement imparted to the lever.

Figure 7:
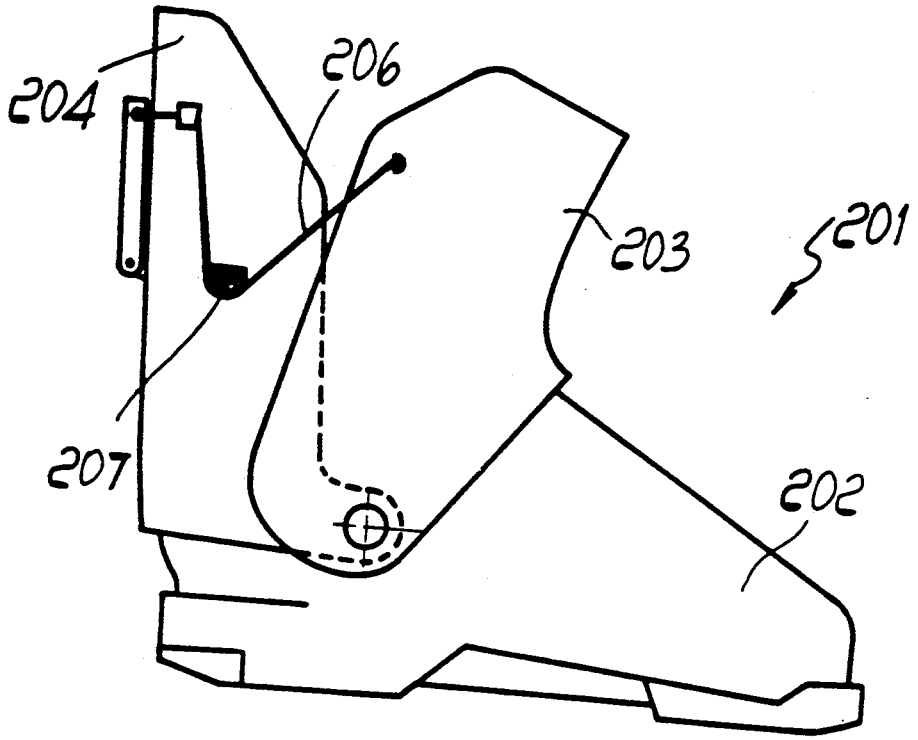
FIG. 7 is a side schematic view of a ski boot with the temporary engagement means located at the rear quarter.
Figure 8:
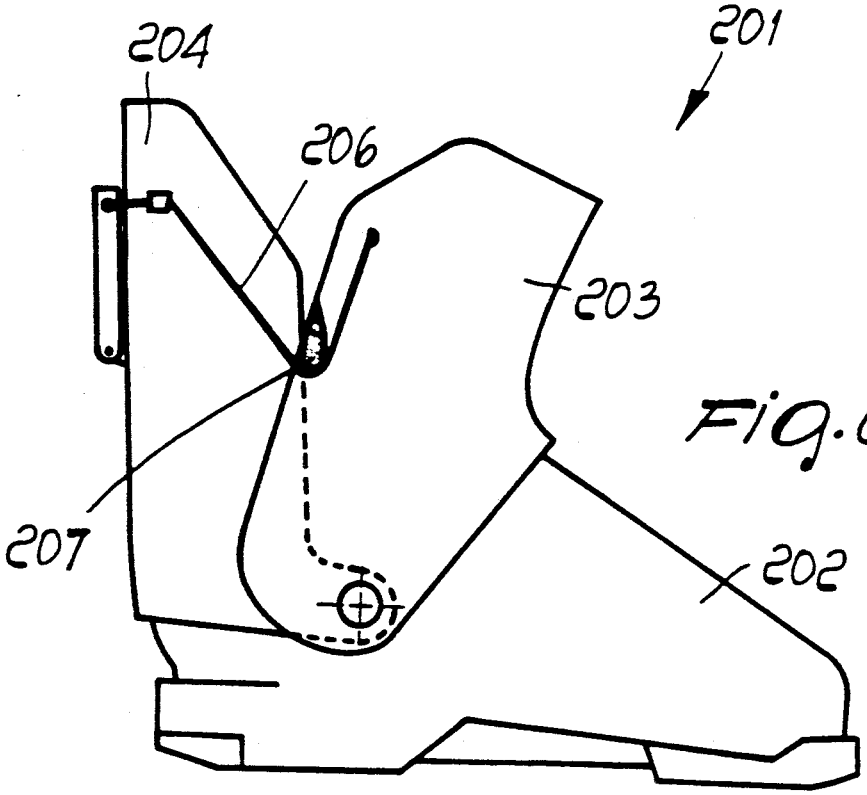
FIG. 8 is a view similar to the preceding one of a ski boot having the temporary engagement means located at the front quarter.

FIGS. 7 and 8 illustrate, in a further variated embodiment, a boot 201 in which the temporary engagement means for the cables 206 are constituted by one or more lugs 207 which protrude perpendicularly and laterally to the front quarter 203 or to the rear quarter 204.

In this case, too, the skier can thus achieve a condition in which the quarters are partially open, which is optimum for walking, with no risk that the foot may slip out of the shell 202.

The dimensions and materials which constitute the individual components of the invention may naturally be the most pertinent according to the specific requirements.

What is claimed is:

1. A ski boot comprising a shell, a front quarter connected to said shell, and a rear quarter pivotally articulated to said shell, said ski boot further comprising a closure device for closing and securing said front and rear quarters about a wearer's lower leg region, said closure device comprising a lever element pivotally articulated to one of said quarters and a traction element connected to said lever element and interconnected between said front and rear quarters whereby a closing actuation of said lever element takes up the working length of said traction element to close said quarters about a wearer's lower leg region and an opening actuation of said lever element frees said rear quarter to rearwardly pivot to thereby allow insertion and removal of a wearer's foot in said ski boot, wherein said closure device further comprises at least one lug engagement element connected to said lever element upon which said traction element releasably engages to take up at least a portion of the working length of said traction element, thereby an intermediate position of said rear quarter with respect to said front quarter is obtained when said traction element engages said lug engagement element in the open position of said level element to allow comfortable and secure walking of the user.

2. Ski boot according to claim 1, wherein said lug engagement element is connected to a lateral surface of said lever element, said lever element being pivoted to said rear quarter at an articulation axis defined thereof, said lug engagement element having a semicircular configuration with a curved end directed towards said articulation axis.

3. Ski boot according to claim 2, wherein said lug engagement element is connected to said lateral surface of said lever element proximate to said articulation axis, said lug engagement element at least partially having an involute profile, said lug engagement element being provided with a groove for accommodation of said traction element.

* * * * *